US006666694B1

(12) United States Patent
Daly et al.

(10) Patent No.: US 6,666,694 B1
(45) Date of Patent: Dec. 23, 2003

(54) REDUCED PROFILE EMI RECEPTACLE ASSEMBLY

(75) Inventors: John J. Daly, Chicago, IL (US); Robert V. Skepnek, Norridge, IL (US); Alex Pirillis, Skokie, IL (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 10/224,839

(22) Filed: Aug. 21, 2002

(51) Int. Cl.[7] ..... H01R 12/00

(52) U.S. Cl. ..... 439/79; 439/607; 439/547; 439/554

(58) Field of Search ..... 439/79, 607, 547, 439/554

(56) References Cited

U.S. PATENT DOCUMENTS 5,316,488 A 5/1994 Gardner et al.
6,109,966 A * 8/2000 Chiou ..... 439/607
6,171,148 B1 * 1/2001 Chiu et al. ..... 439/607
6,364,708 B1 * 4/2002 Chen et al. ..... 439/607
6,368,167 B1 * 4/2002 Ma et al. ..... 439/607
6,398,587 B1 * 6/2002 Chen et al. ..... 439/607

OTHER PUBLICATIONS

SFP MSA SFF–8074i Rev. 1.0, May 12, 2001.

* cited by examiner

*Primary Examiner*—Tho D. Ta
(74) *Attorney, Agent, or Firm*—Seyfarth Shaw LLP

(57) ABSTRACT

The present invention provides for a receptacle printed circuit board assembly having a reduced profile of the entire assembly where the receptacle has a board receiving portion that mounts at a cut-out edge of a printed circuit board so that the majority of the receptacle is mounted within a cut-out area of the printed circuit board recessed below the upper face of the printed circuit board so that the overall profile of the receptacle assembly is reduced. A shield flap or metallic hood is provided that helps to attach the receptacle to the printed circuit board and completely enclose the shielded portion of the receptacle.

17 Claims, 3 Drawing Sheets

REDUCED PROFILE EMI RECEPTACLE ASSEMBLY

The present invention pertains to a receptacle assembly for shielding electromagnetic interference (EMI) and in more particular an EMI receptacle for receiving an electronic component therein such as an electronic or optoelectronic transceiver device for mounting to the EMI receptacle of a host device.

BACKGROUND OF THE INVENTION

Receptacles for receiving electronic devices are known by such terms as receptacles, guide rails, cages or sockets. In many applications, multiple receptacles are mounted to a motherboard in side-by-side orientation. Multiple motherboards may be mounted within a host device so that rows of receptacles are provided. Generally the motherboard forms a planer surface which abuts the exterior wall or chassis of the host device. A hole is made in the chassis or a separate faceplate is formed in the chassis in order to provide a port through with electronic devices may be inserted into the receptacle which is mounted on the motherboard. In some circumstances the end of the receptacle may protrude through the faceplate opening in order to guide the electronic component within the receptacle and into the host device.

Receptacles that are known include small form factor pluggable (SFP) transceiver receptacles as disclosed in Multi-Source Agreement (MSA) (SFF-80741) which discloses a receptacle to receive an SFP transceiver therein. The receptacle or receptacle disclosed in the MSA includes mounting posts along the bottom of the receptacle so that the mounting posts may be received in the upper surface of the motherboard so that the receptacle is mounted onto the motherboard and the entire receptacle protrudes above the upper surface of the motherboard. Likewise, the electrical connector which is surrounded by the receptacle is surface mounted to a land grid array pattern provided on the upper face of the motherboard.

In such devices, the receptacle may have a height and protrudes above the motherboard by approximately 0.385 inches. When multiple motherboards are stacked or aligned within a host device in order to provide rows of receptacles within the host device, the height of the receptacle provides a limiting factor and dictates the spacing between the motherboards. Therefore, in the above example, the motherboards of a host device could not be spaced closer than 0.385 inches. In fact, some clearance is desirable between the top of a receptacle and the bottom of a motherboard in order that no metal to metal contact or electrical interconnection is made between the top of the receptacle and the bottom of the adjacent motherboard and also to allow for air circulation for cooling. Due to such spacing limitations a host device such as a router, hub or switch can only accommodate a limited number of rows of receptacles. Since the width of a side of a host device has a limited size based on the location to which the host device will be oriented, such as on a rack in a computer room or in a wiring closet; only a limited amount of space is available on the host device for providing rows of receptacles.

As the bandwidth capacity of a host device is increased, it is desirable to have additional ports available for more and more electronic devices such as transceivers. One manner of increasing the number of ports available in a host device is to allow for additional motherboards to be stacked within the host device in order to provide additional rows of receptacles. However, due to the limitations discussed above, with regard to the height that the receptacle protrudes above the motherboard, additional rows or receptacles are difficult to add in the confined width of a host device. As well, relocating of the motherboard with respect to the cut-out opening in the bezel or faceplate of the host device provides for better cable management and cooling of the receptacles and for the electronic devices mounted therein. Therefore, it would be desirable to provide a receptacle and motherboard assembly which provides for a reduced profile of the receptacle above the motherboard so that additional motherboards may be stacked side by side in order to allow for additional rows of receptacles in a host device. Such a reduced profile receptacle and motherboard assembly is provided by the present invention.

SUMMARY OF THE INVENTION

A receptacle assembly is provided comprising a printed circuit board having a cut-out portion along an edge of the printed circuit board. The receptacle includes a receptacle opening for receiving an electronic component therein. At the end opposed to the receptacle opening a board receiving portion is located between a top surface and a bottom surface of the receptacle. The receptacle is mounted to the printed circuit board at the board receiving portion so that the receptacle is recessed within the cut-out and a height that the receptacle protrudes beyond a major surface of the printed circuit board is less than a total height of the receptacle. The printed circuit board may include a mounting footprint for receiving mounting members or tabs of the receptacle. The receptacle board receiving portion includes a cut-out area of the receptacle having a mounting member tab protruding therefrom for insertion into an aperture in the printed circuit board.

In an embodiment, the receptacle may include a shield flap attached to the receptacle adjacent the board receiving portion. The shield flap may include a mounting tab for insertion into the printed circuit board. The shield flap may be pivotally attached to the receptacle. In an embodiment, the shield flap may include a living hinge formed between the shield flap and the receptacle. The shield flap may substantially enclose the board receiving portion of the receptacle. The board receiving portion may attach to a first side of the printed circuit board and the shield flap may attach to a second side of the printed circuit board. In an embodiment, a first mounting tab of the board receiving portion may be received in a first aperture on the first side of the printed circuit board and protrude toward the second side of the printed circuit board and a second mounting tab of the shield flap may be received in a second aperture on the second side of the printed circuit board and protrude toward the first side. An electrical connector may be provided that straddle mounts to the printed circuit board at the cut-out and is adjacent the board receiving portion of the receptacle. A top frame and/or bottom frame for supporting the receptacle within the cut-out may be provided.

In another embodiment, a metallic receptacle is provided for receiving and shielding an electronic component received therein and the receptacle comprises a first end forming and opening for receiving the electronic device therethrough, a second end having a board mounting area formed by at least two sides of the receptacle recessed from a major body edge of the receptacle formed along a majority of the receptacle between the first end and the second end and a shield flap attached at the second end adjacent the board mounting area. The sides of the receptacle may include mounting tabs for mounting the receptacle to a first side of a printed circuit board. In an embodiment, the shield flap may include mounting tabs for attaching the shield flap to second side of the printed circuit board. The shield flap may substantially enclose the second end of the receptacle. The shield flap may be pivotally attached to the receptacle via a living hinge. In an embodiment, a top frame support may be provided at the first end of the receptacle in order to assist in supporting the first end of the receptacle within a cut-out portion of the printed circuit board within which the receptacle is mounted. The first end of the receptacle may be supported by a bottom support frame attached at the first end of the receptacle and supporting the first end within a cut-out portion of a printed circuit board within which the receptacle is mounted. The board mounting area may form an open area allowing for the insertion therethrough of an electrical connector. The electrical connector may be attached to a printed circuit board.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF A PRESENTLY PREFERRED EMBODIMENT

Figure 1:
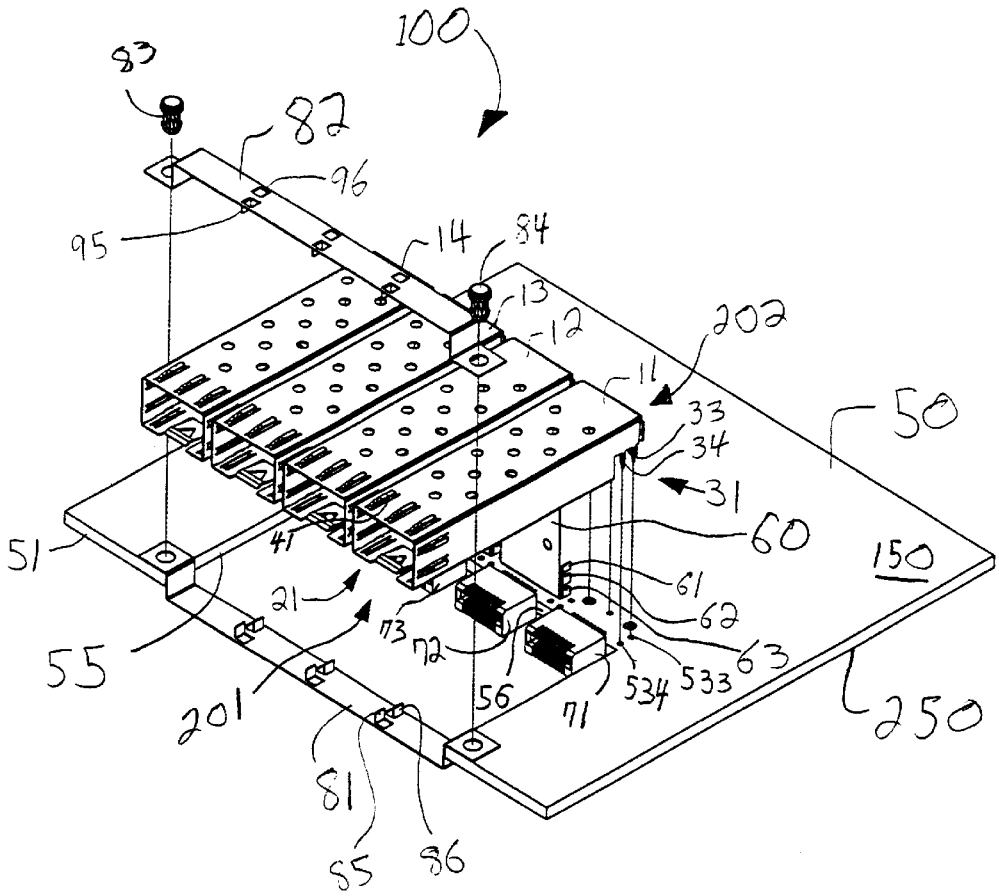
FIG. 1 is an exploded perspective view of the receptacle and motherboard assembly of the present invention.

The present invention is described with reference to a preferred embodiment that is depicted in FIGS. 1–8. Turning to FIG. 1 an exploded perspective view of a receptacle and motherboard assembly 100 is depicted having motherboard 50 with four receptacles 11, 12, 13, 14 shown elevated above the printed circuit board or motherboard 50 prior to assembly thereto. Each receptacle or cage 11, 12, 13, 14 are identical in construction and a description will be provided for the first receptacle 11 which will be a description for the other receptacles. The receptacle 11 includes a receptacle opening 21 at its first end 201. Opposed to the receptacle opening 21 at a second end 202 of the receptacle 11 is a board receiving portion 31. In a preferred embodiment the receptacle 11 is formed of a metallic material such as a stamped and formed sheet of stainless steel forming a five-sided structure having an open cut-out portion forming the board receiving portion 31 at a bottom second end of the receptacle 11. However, alternative embodiments of the receptacle 11 may be provided formed of other materials such as metalized plastic.

The receptacle 11 may include mounting members, for example, tabs 33, 34 provided within a cut-out section which forms the board receiving portion 31 of the receptacle 11. Adjacent the board receiving portion 31 is a metallic hood or shield flap 60. The shield flap 60 in a preferred embodiment is attached to the bottom of the receptacle 11 via a living hinge which allows the shield flap 60 to pivotally rotate between an open position as shown in FIG. 1 and a closed position (shown in FIG. 4 and FIG. 8). However, in an alternate embodiment a metallic hood may be provided that is separately stamped and formed of metal sheet that may be attached to the bottom of the receptacle via soldering or other mechanical means after the receptacle is mounted to the printed circuit board 50. In an embodiment, the metallic hood may form a four-sided structure that encloses the board receiving portion 31 of the receptacle 11 in order to shield a first edge 51 of the printed circuit board and complete the enclosure around an electrical connector mounted at the first edge 51. However, the hood may also be curvilinear in form. The shield flap or metallic hood 60 may include tabs 61, 62, 63 for abutting the printed circuit board 50. The receptacle 11 is secured to the printed circuit board 50 by mounting tabs 33, 34 engaging apertures 533, 534 and mounting tabs 35, 37 (shown in FIG. 3 and adjacent mounting tabs 33, 34) of the board receiving portion 31 being received in apertures of the first side 150 of the printed circuit board 50. In an embodiment the mounting tabs 35 and 37 engage holes formed in the terminal ends of the tabs 64, 66 and are received in apertures on a second side 250 of the printed circuit board 50. In an embodiment the tabs 35, 37 may protrude through the apertures 533, 534 exiting the second side of the printed circuit board 50. The first side 150 provides an upper major surface of the printed circuit board upon which a majority of the components such as integrated circuits are mounted.

A rectangular shaped cut-out area 55 is formed at the first edge 51 of the printed circuit board 50 forming an offset edge 56. Electrical connectors 71, 72, 73 are mounted to the printed circuit board 50 at the offset edge 56 of the cut-out area 55. In a preferred embodiment, straddle mount electrical connectors 71, 72, 73 are provided to mount to the offset edge 56 of the cut-out 55. A fourth electrical connector (not shown) is mounted next to the third electrical connector 73. Each electrical connector 71, 72, 73, 74 corresponds with each corresponding receptacle 11, 12, 13, 14 which is mounted to surround the electrical connectors 71, 72, 73. In a preferred embodiment the electrical connectors 71, 72, 73 receive a card edge connection of an electronic component, such as a transceiver which is mounted within the receptacle 11. It should be understood that although four receptacles 11, 12, 13, 14 and four electrical connectors 71, 72, 73, 74 are depicted in FIG. 1 the present invention may provide a receptacle and printed circuit board assembly for any number of receptacles and connectors. As well, the receptacle 11 of the present invention may accommodate any type of electrical connector mounted in alternate orientations, such as to the printed circuit board or to the receptacle itself.

A preferred method of assembling the present invention will be described with reference to FIG. 1. A motherboard 50 is provided having cut-out 55 provided therein. The apertures such as the mounting tab receiving apertures 533, 534 are provided in the motherboard 50 and adjacent the apertures are provided a footprint having a land grid array pattern for receiving straddle mount tails of electrical connectors 71, 72, 73. The electrical connectors are attached to the offset edge 56 of the cut-out area 55 by sliding the straddle mount tails over the offset edge 56 of the printed circuit board 50 and a friction fit is provided in order to hold the electrical connectors 71, 72, 73 in place at the provided footprint of the motherboard 50. The footprint includes solder pads that may be reflowed in order to connect the solder tails 87 (FIG. 6) of the electrical connectors 71, 72, 73 to the printed circuit board 50 and provide an electrical connection thereto. A bottom frame support 81 is then attached to the printed circuit board 50 adjacent the edge 51 of the printed circuit board 50.

Figure 3:
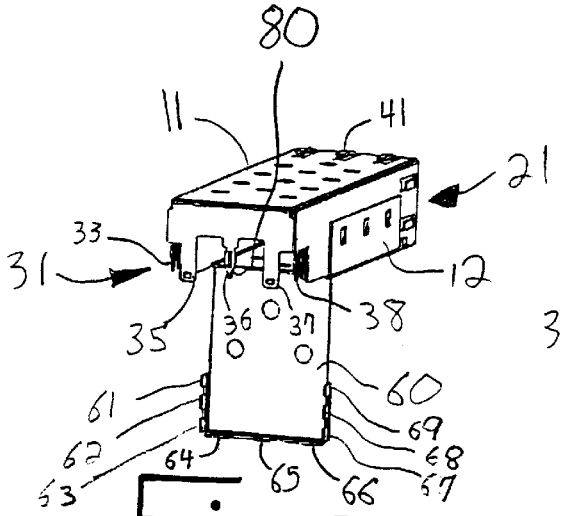
FIG. 3 is a perspective view of the receptacle with a shield flap in an open position.
Figure 4:
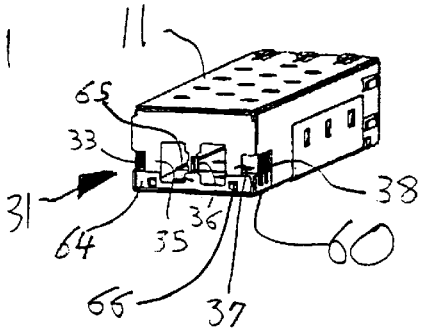
FIG. 4 is a perspective view of the receptacle of the present invention with the shield flap in a closed position.

Each receptacle 11, 12, 13, 14 is then mounted within the cut-out 55 so that the mounting tabs 33, 34 are received in the apertures 533, 534. In a preferred embodiment the apertures 533, 534 are bores that are coated with solder paste. As the receptacle 11 is mounted to the printed circuit board 50 the shield flap 60 is inserted through the cut-out 55 and protrudes below the bottom face of the second side 250 of the printed circuit board 50. The shield flap 60 is then rotated up towards the second side 250 of the printed circuit board 50 so that the mounting tabs 64, 66 are engaged by mounting tabs 35, 37 (FIGS. 3 and 4). In an embodiment, the mounting tabs 35, 37 have formed latches that are received by holes in the mounting tabs 64, 66. The apertures 533, 534 for receiving mounting tabs 33, 34 in an alternate embodiment, may not be coated with solder paste. However, such apertures 533, 534 in an embodiment have a ground plane exposed therein to make electrical contact with the mounting tabs 33, 34 in order to ground the receptacle thereto. A top frame support 82 is then mounted over the receptacle opening ends 21 of the receptacles 11, 12, 13, 14. In an embodiment, fasteners such as thumb screws 83, 84 are inserted through apertures at the ends of the top frame and bottom frame supports 81, 82 in order to secure the frame supports 81, 82 to the printed circuit board 50 and secure the receptacle opening ends 21 of the receptacles 11, 12, 13, 14 to the printed circuit board 50. Each frame includes alignment tabs 85, 86 and 95, 96, respectively, in order to align each receptacle 11, 12, 13, 14 laterally on the frame support 81, 82 so that cut-out 121, 122 of the faceplate 120 will align with the end of the receptacle.

The entire assembly 100 may then be placed in a reflow oven in order to reflow the solder provided at the footprint of the pads for the contact tails 87 of the electrical connectors 71, 72, 73 and to reflow the solder paste (if present) within the apertures 533, 534 that receive the mounting tabs 33, 34. After the reflow process, the assembly 100 is allowed to cool and the solder to cure which helps secure the mounting tabs 33, 34 within the apertures in order to rigidly secure the receptacles 11, 12, 13, 14 to the printed circuit board 50.

In a further method of assembly in a preferred embodiment, the motherboard 50 is then mounted within a host device. Additional motherboards may also be stacked next to the motherboard 50 in order to provide rows of receptacles 11, 12, 13, 14 within a host device. A faceplate 120 (FIG. 2) may then be placed along the outer edge 51 of the motherboard 50 in order to enclose the edge 51 of the host device. In a preferred embodiment, the faceplate 120 is a metallic/conductive material which provides for shielding. The faceplate 120 abuttingly connects with ground tabs 41 of the receptacle openings 21 in order to provide for a EMI shielded assembly 100. It may be understood that the mounting of multiple motherboards 50 within a host device may occur where the motherboard 50 is either in a horizontal or vertical orientation. Therefore, the reference to rows of cages 11 or receptacles also refers to columns of receptacles or cages when the motherboard 50 is oriented vertically.

Figure 2:
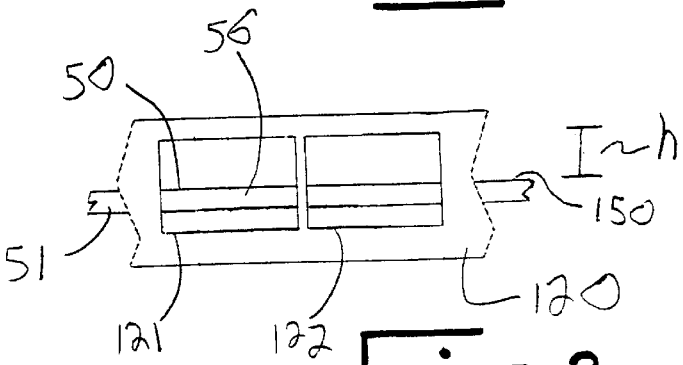
FIG. 2 is a side elevation partial view of a faceplate of a host device attached to a motherboard oriented in a preferred embodiment of the present invention.

Turning to FIG. 2, a side elevation partial view of a host device is depicted having a faceplate 120 having a first cut-out 121 and a second cut-out 122, that provide for two ports in communication with receptacles mounted therein. Motherboard or printed circuit board 50 has an edge 51 and offset edge 56. The view depicted in FIG. 2, for the sake of simplicity, does not include the receptacles 11, 12, 13, 14 mounted to the printed circuit board 50. It may be understood that in a preferred embodiment the receptacles 11, 12, 13, 14 are mounted to the printed circuit board 50 and the faceplate 120 is placed over the receptacle opening ends 21 of each receptacle 11, 12, 13, 14. Each rectangular shaped receptacle opening 21 protrudes through the rectangular shaped cut-outs 121, 122 of the faceplate 120. The mounting of the receptacles 11, 12, 13, 14 in the cut-out area 55 of the printed circuit board 50 adjacent the offset edge 56 provides for a reduced profile receptacle assembly. The profile is defined by the height that the top surface of the cages 11 protrudes above the upper major surface 150 of the printed circuit board 50.

As may be understood in view of the above description, a portion of each receptacle 11, 12, 13, 14 is recessed below the upper major surface 150 of the printed circuit board 50. By recessing a portion of each receptacle 11, 12, 13, 14 below the major surface 150, the upper portions of the receptacles 11, 12, 13, 14 do not protrude above the major surface 150 of the printed circuit board 50 as much as if there were no cut-out 55 and the receptacles 11, 12, 13, 14 were mounted directly onto the top of the major surface 150 of the printed circuit board 50. Due to the recessed mounting, the profile or height h between the upper major surface 150 of the printed circuit board and the top of each receptacle 11, 12, 13, 14 is greatly reduced. In FIG. 2 the top of the receptacle is depicted as the top of the cut-outs 121, 122. In a preferred embodiment, the cut-outs 121, 122 of the faceplate 120 very closely engage the top portion of the receptacles 11, 12, 13, 14 and when measured from the major surface 150 of the printed circuit board 50 are, therefore, approximately equal to height h. Therefore, h as identified in FIG. 2, represents the height of the receptacles 11, 12, 13, 14 above the major surface 150 of the printed circuit board 50. In a preferred embodiment h is less than the total height of the cage 11 and in particular h=0.244 inches. However, it may be understood that the present invention provides for the increased density of vertical stacking of rows or columns of receptacles of motherboards which is an improvement over prior art devices. In the specific example of an SFP cage constructed according to the MSA, a reduced profile assembly is provided when h is between 0.0 and 0.385 inches.

As discussed above, the faceplate 120 in a preferred embodiment is a metallic material in order to provide for shielding of components mounted on the printed circuit board 50. Ground tabs 41 are provided at the receptacle opening end 21 of the receptacle 11 (see FIG. 1). The ground tabs 41 abut against the cut-outs 121, 122 of the faceplate 120. The ground tabs 41 in a preferred embodiment are also metallic and provide an electrical connection between the receptacle 11 and faceplate 120. Such an electrical connection between the ground tabs 41 and faceplate 120 helps to reduce EMI and provide for grounding of the receptacle 11, 12, 13, 14 to the same ground potential of the chassis faceplate 122, to generally earth or chassis ground. Therefore, it may be understood that upon insertion of an electrical device such as a transceiver through the cut-outs 121, 122 and into the receptacles 11, 12, 13, 14 the transceiver may provide for static discharge to the faceplate 120 or receptacles 11, 12, 13, 14 and upon operation, the transceiver's electromagnetic radiation from its high speed circuitry will be shielded and will not harm other components mounted on the printed circuit board 50 adjacent the cut-out area 55.

Turning to FIG. 3, a perspective view of the receptacle 11 is shown from a rear view having mounting tab 33 shown at one side of the board receiving portion 31. Additional mounting tabs 35, 36, 37 and 38 are also disclosed protruding down into the board receiving portion 31. Shield flap 60 is depicted having tabs 61, 62, 63, 64, 65, 66, 67, 68 and 69 protruding therefrom. In a preferred embodiment tabs 64 and 66 act as mounting tabs to secure the shield flap 60 in its closed position attached at the board receiving portion 31. Opposite the board receiving portion 31 is the receptacle opening end 21 of the receptacle 11. In a preferred embodiment the receptacle 11 is formed of a single sheet of metal and is stamped and formed to provide the receptacle defining a box like structure and is secured in its box like structure via side flaps 12.

As was discussed with regard to FIG. 1, the assembly of the receptacle 11 to the motherboard 50 may be understood more particularly with regard to the view shown in FIG. 3. The initial step of mounting the receptacle 11 to the motherboard 50 provides for the insertion of mounting tabs 33, 35, 36, 37 and 38 into apertures located in the first side 150 of the printed circuit board 50. The board receiving portion 31 of the receptacle 11 is mounted onto the offset edge 56 of the printed circuit board 50 so that a majority of the receptacle 11 protrudes beyond the offset edge 56 of the printed circuit board and is received within the cut-out 55 of the printed circuit board 50. The shield flap 60 is then pivotally moved on its living hinge 80 so that mounting tabs 64, 66 engage mounting tabs 33, 37. As is shown in FIG. 4, the receptacle 11 is depicted having shield flap 60 in its closed position. In order to simplify the view of the receptacle 11, it is depicted without a printed circuit board 50 mounted at the board receiving portion 31 so that the mounting tabs 33, 35, 36, 37, 38, 64, 65, 66 may be viewed. Each of these mounting tabs are inserted in apertures from the top and bottom of the printed circuit board 50 in order to securely attach the receptacle 11 to the printed circuit board 50 and also to completely enclose the receptacle 11. It may be understood that when the receptacle 11 is mounted over electrical connector 71, 72, 73 the shield flap 60 surrounds the bottom of the electrical connector 71 and encloses the board receiving portion 31 of the receptacle 11.

Figure 5:
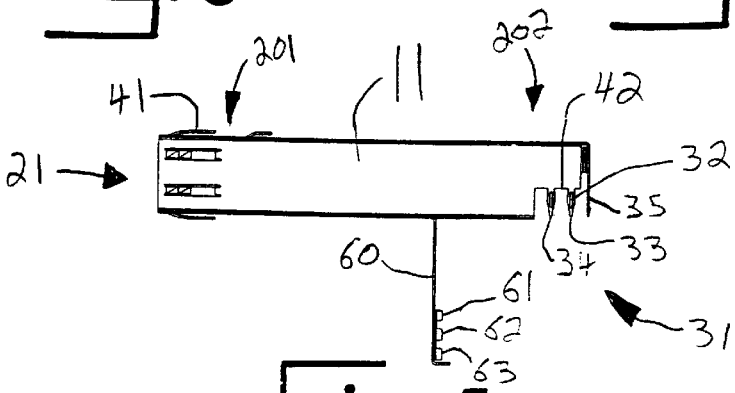
FIG. 5 is a side elevation view of the receptacle of the present invention with the shield flap in an open position.

As is shown in FIG. 5, the receptacle 11 is depicted having the shield flap 60 in its open position. The receptacle 11 has the board receiving portion 31 formed by a cut-out edge 42 having the mounting members or tabs 44, 43 protruding therefrom on a first side and 35 on a second side provide for the quick and easy mounting of the receptacle 11 to the offset edge 56 of the printed circuit board 50. In a preferred embodiment, the mounting members 33, 34 are press-fit pins having a center hole 32 so that upon insertion in apertures 533, 534, respectively (FIG. 6), the sides of the press-fit pins 33, 34 may compress and provide a friction fit in order to maintain the pins 33, 34 within the apertures 533, 534 and retain the receptacle 11 on the printed circuit board 60. The compression of the pins 33, 34 against the sides of the apertures 533, 534 in an embodiment also provide for an electrical connection to a ground plane exposed within the apertures 533, 534. The cut-out edge 42 is formed approximately midway between a top surface and a bottom surface (each providing a major body edge) of the receptacle 11 at a second end 202. The distance between the top and bottom surface of the cage 11 provides a total height of the cage 11. The simple action of closing of the shield flap 60 simultaneously secures the receptacle 11 to the printed circuit board 60 while also providing a completely shielded enclosure of the receptacle 11.

Figure 6:
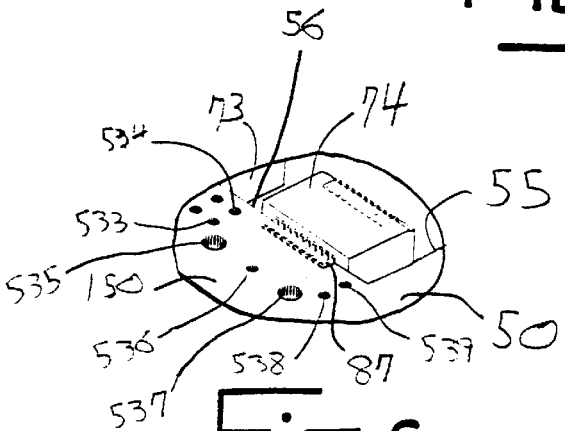
FIG. 6 is an enlarged perspective view of an electrical connector of the present invention mounted to the cut-out portion of the motherboard of the present invention.
Figure 7:
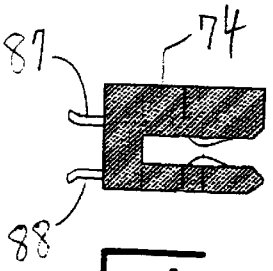
FIG. 7 is a side elevation view of an electrical connector of the present invention.

FIG. 6 depicts electrical connector 74 mounted to printed circuit board 50. FIG. 6 is an enlarged view of printed circuit board 50 of FIG. 1 rotated 180° to depict the mounting tails 87 of the electrical connector 74 mounted to the offset edge 56 forming cut-out 55 of printed circuit board 50. Electrical connector 74 is shown adjacent to electrical connector 73 which is adjacent electrical connectors 72 and 71 disclosed in FIG. 1. FIG. 7 also depicts the electrical connector 74 including mounting tails 87, 88. The mounting tail 87 is received on the first side 150 of the printed circuit board 50 and the mounting tail 88 is received on the second side 250 of the printed circuit board. Each mounting tail 87, 88 represents each of the nine other tails located in a top (FIG. 6) and bottom row adjacent the tails 87, 88 depicted in the preferred embodiment depicted in FIG. 7 on each side of the electrical connector 74 providing twenty total contact tails formed as part of the twenty total contacts. However, many other types and sizes of electrical connectors can be used with the present invention.

The printed circuit board 50 includes apertures 534, 533, 535, 536, 537, 538 and 539 for receiving mounting tabs 34, 33, 35, 36, 37, 38 and 39 (see FIG. 3) respectively, therein. These apertures define a footprint area which also includes the mounting pads for receiving the contact tails 87 thereon of the printed circuit board 50.

Figure 8:
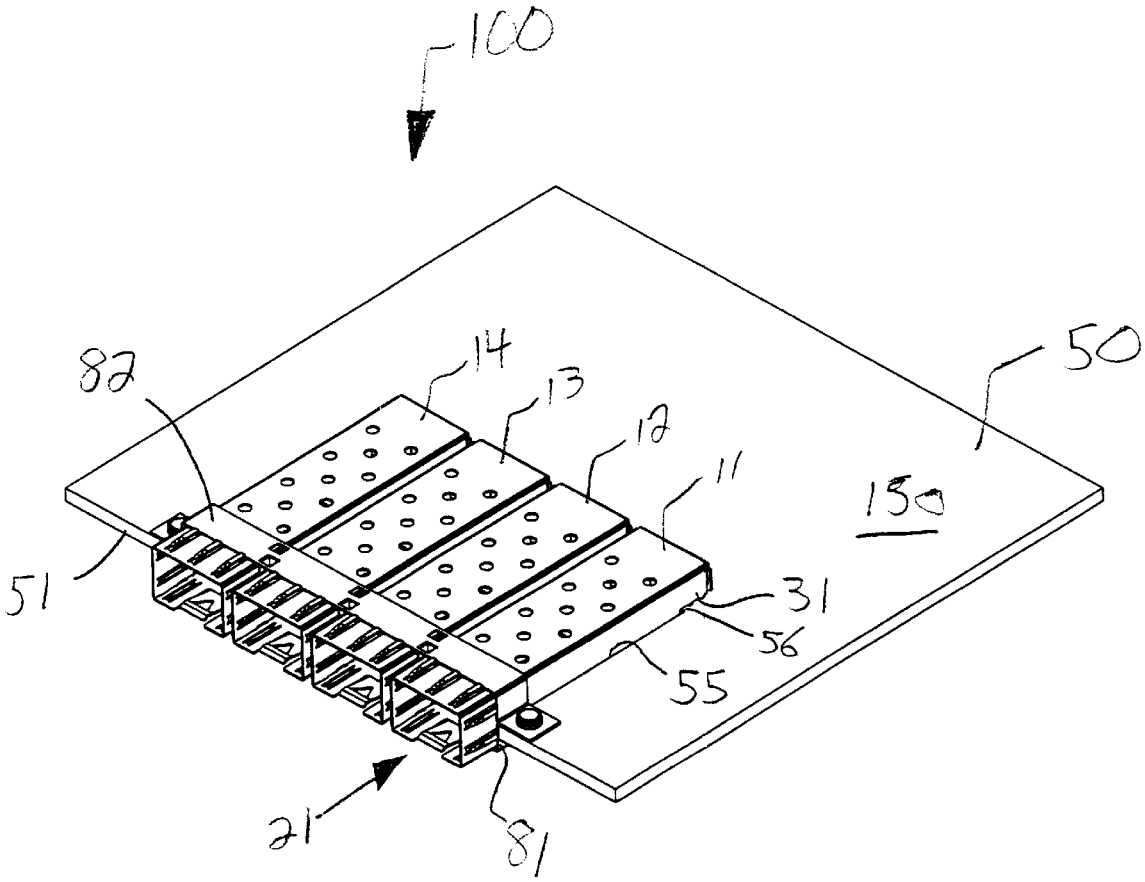
FIG. 8 is a perspective view of the receptacle and motherboard assembly of the present invention.

Turning to FIG. 8 a fully assembled receptacle and motherboard assembly 100 is depicted having receptacles 11, 12, 13, 14 mounted to printed circuit board 50 so that the majority of the receptacles 11, 12, 13, 14 are received within cut-out 55. The board receiving portion 31 is mounted to the offset edge 56 of the printed circuit board 50. The receptacle opening end 21 is shown captured by the top frame support 82 and bottom frame support 81 mounted to the motherboard 50 so that the receptacle openings 21 protrude beyond the first edge 51 of the printed circuit board 50. It can be seen from this view that the receptacles 11, 12, 13, 14 are recessed below the upper major surface 150 of the printed circuit board and have a reduced profile and allow for the tighter stacking of multiple motherboards 50 in order to provide additional rows or columns of receptacles 11, 12, 13, 14 in a host device.

The matter set forth in the foregoing description and accompanying drawings is offered by way of illustration only and is not as a limitation. While particular embodiments have been shown and described, it will be obvious to those skilled in the art that changes and modifications may be made without departing from the broader aspects of applicant's contribution. The actual scope of the protection sought is intended to be defined in the following claims when viewed in their proper perspective based on the prior art.

What is claimed is:

1. A receptacle assembly including a printed circuit board having a cut-out portion along an edge of the printed circuit board and a major upper surface and a receptacle mounted to the cut-out portion of the printed circuit board and the receptacle has an opening for receiving an electronic component therein and the printed circuit board and the receptacle assembly have a profile defined by a height that a top surface of the receptacle is above the major upper surface and the receptacle is recessed within the cut-out portion so that the profile is less than a total height between the top surface and a bottom surface of the receptacle and wherein the improvement comprises:

a board receiving portion formed in the receptacle between the top and bottom surfaces at the end opposed to the opening and the board receiving portion includes a mounting member therein; and the receptacle includes a shield flap attached to the receptacle adjacent the board receiving portion and the board receiving portion attaches to a first side of the printed circuit board and the shield flap attaches to a second side of the printed circuit board and a first mounting tab of the board receiving portion is received in a first aperture on the first side of the printed circuit board and protrudes toward the second side of the printed circuit board and a second mounting tab of the shield flap is received in a second aperture on the second side of the printed circuit board and protrudes toward the first side.

2. The receptacle assembly of claim 1 wherein the printed circuit board includes a mounting footprint having apertures for receiving the mounting member projecting from the board receiving portion of the receptacle.

3. The receptacle assembly of claim 1 wherein the board receiving portion includes a cut-out area of the receptacle and wherein the mounting member includes a press-fit pin protruding from the cut-out area for insertion into an aperture of the printed circuit board.

4. The receptacle assembly of claim 1 wherein the shield flap includes a mounting tab for insertion into the printed circuit board.

5. The receptacle assembly of claim 1 wherein the shield flap substantially encloses the board receiving portion of the receptacle.

6. The receptacle assembly of claim 1 including a bottom frame for supporting the receptacle within the cut-out.

7. The receptacle assembly of claim 1 wherein the shield flap is pivotally attached to the receptacle.

8. The receptacle assembly of claim 7 wherein the shield flap includes a living hinge formed between the shield flap and the receptacle.

9. A metallic receptacle for receiving and shielding an electronic component received therein and having a first end forming an opening for receiving the electronic device therethrough wherein the improvement comprises:

a board receiving portion formed at a second end of the receptacle by at least two sides of the receptacle recessed from a major body edge of the receptacle formed along a majority of the receptacle between the first end and the second end; and the receptacle includes a metallic hood attached to the receptacle adjacent the board receiving portion and the board receiving portion attaches to a first side of the printed circuit board and the metallic hood attaches to a second side of the printed circuit board and a first mounting tab of the board receiving portion is received in a first aperture on the first side of the printed circuit board and protrudes toward the second side of the printed circuit board and a second mounting tab of the metallic hood is received in a second aperture on the second side of the printed circuit board and protrudes toward the first side.

10. The metallic receptacle of claim 9 wherein the metallic hood substantially encloses a bottom second end of the receptacle.

11. The metallic receptacle of claim 9 wherein the metallic hood is pivotally attached to the receptacle via a living hinge.

12. The metallic receptacle of claim 9 wherein a bottom frame support is provided adjacent the first end of the receptacle in order to assist in supporting the first end of the receptacle within a cut-out portion of a printed circuit board within which the receptacle is mounted.

13. The metallic receptacle of claim 9 wherein the opening of the receptacle is supported by a bottom support frame attached at the first end of the receptacle and supporting the first end within a cut-out portion of a printed circuit board within which the receptacle is mounted.

14. The metallic receptacle of claim 9 wherein the board receiving portion forms an open area allowing for the insertion therethrough of an electrical connector.

15. The metallic receptacle of claim 14 wherein the electrical connector is attached to a printed circuit board.

16. The metallic receptacle of claim 9 wherein the receptacle is formed of a stamped and folded metal sheet forming at least a four-sided structure having an open portion at the second end forming the board receiving portion.

17. The metallic receptacle of claim 16 wherein the metallic hood at least partially forms a fifth side of the metallic receptacle.

* * * * *